United States Patent [19]

Roggenburg, Jr. et al.

[11] Patent Number: 4,570,827

[45] Date of Patent: Feb. 18, 1986

[54] LIQUID DISPENSER

[75] Inventors: Stanley L. Roggenburg, Jr., Staten Island, N.Y.; Robert H. Laauwe, Franklin Lakes, N.J.

[73] Assignee: Essex Chemical Corp., Clifton, N.J.

[21] Appl. No.: 594,383

[22] Filed: Mar. 28, 1984

[51] Int. Cl.[4] ..... B65D 35/28; B67D 5/06

[52] U.S. Cl. ..... 222/95; 222/103; 222/105; 222/181

[58] Field of Search ..... 383/901, 907; 222/94, 222/103, 105, 207, 214, 181, 633, 325, 209, 92, 95, 107

[56] References Cited

U.S. PATENT DOCUMENTS

| | | | |
|---|---|---|---|
| 698,861 | 4/1902 | Schan | 383/907 |
| 2,329,917 | 9/1943 | Lautmann | 222/209 |
| 3,641,999 | 2/1972 | Greene | 222/107 |
| 4,149,633 | 4/1979 | Nilson | 222/449 |
| 4,478,356 | 10/1984 | Roggenberg, Jr. et al. | 222/94 |

*Primary Examiner*—Joseph J. Rolla
*Assistant Examiner*—Andrew Jones
*Attorney, Agent, or Firm*—Kenyon & Kenyon

[57] ABSTRACT

A liquid dispenser includes a flexible bag, an enclosing box and an actuator. The bag is formed with two chambers, a supply chamber and a discharge chamber, and a hole through which the actuator moves. The discharge chamber has a discharge member which is acted upon by the actuator to dispense a measured discharge. The bag is suspended in the housing with the discharge chamber folded relative to the supply chamber.

5 Claims, 9 Drawing Figures

Fig. 4.
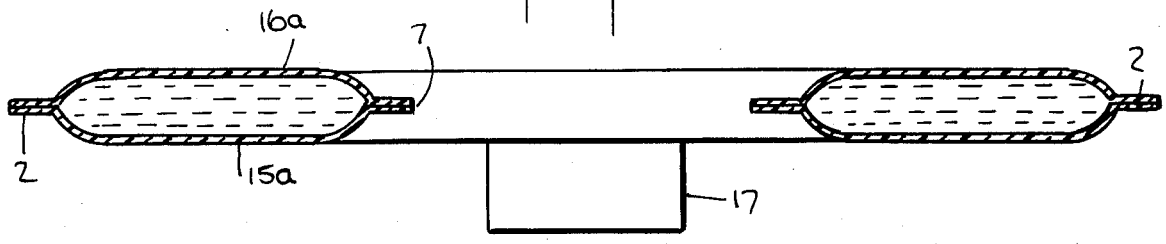
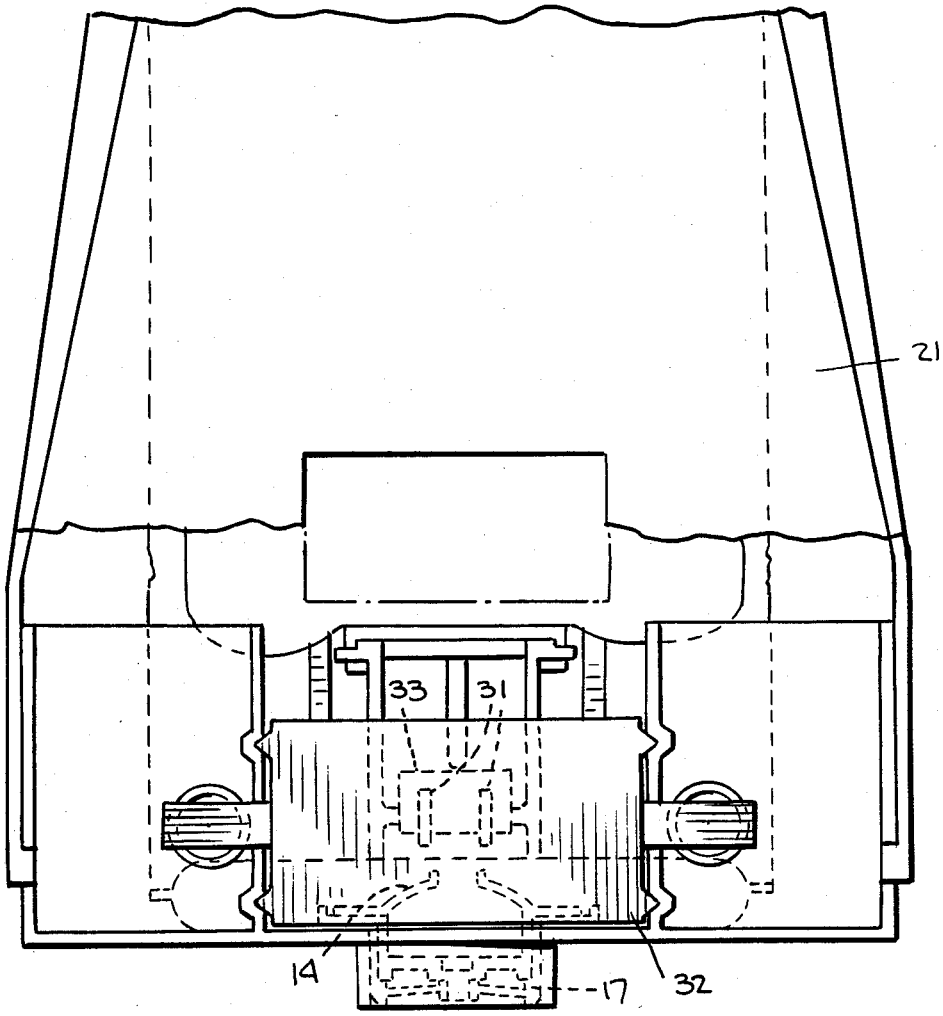
Fig. 8.

LIQUID DISPENSER

Liquid dispensers, particularly for liquid soap, are used in washrooms and other places. Such a dispenser has a container for the liquid and having a valve with a manual operator which the user presses or pulls, the valve dispensing a more or less metered volume of the liquid.

One prior art type comprises a flexible plastic bag containing a supply of liquid soap and sealed hermetically. The bag has a bottom portion where a dispensing valve is sealed in the back wall. This type is exemplified by the Nilson U.S. Pat. No. 4,149,633.

The valve is in the form of a pump of the type shown by the Lautmann U.S. Pat. No. 2,329,917 and which essentially comprises a chamber formed on one side by a closure provided with a check valve and on the other side by an elastically flexible dome having a centrally located hole. When the dome is immersed in the soap in the bag the soap enters the hole and fills the chamber and when the hole is closed by a finger pressing on and collapsing the dome the chamber discharges through the check valve. When the finger is removed the dome springs back to its uncollapsed shape and more fluid flows into the chamber through the dome's hole, the check valve preventing backflow through it into the chamber. Each time the dome is pressed with its hole closed by the finger, a more or less metered volume of soap is discharged through the valve, the metered amount depending on the size of the chamber assuming the dome is substantially completely collapsed for each discharge.

This valve is sealed in the back wall of the plastic bag with the collapsible dome on the inside of the bag and immersed in the soap, finger pressure on the outside of the bag's front wall depressing that wall so that it contacts and closes the dome's hole and depresses the dome which, acting as the valve's operator on the inside of the bag, then effects the discharge of the soap through the check valve which extends on the outside of the bag.

In use the bag is suspended by its top vertically, its bottom portion containing the valve being folded horizontally on a supporting horizontal shelf having a hole through which the check valve depends and with the bag's front wall uppermost for downward pressing. A rigid box is used to contain the bag and provide the shelf. Above the fold line of the bag's folded bottom portion, the bag bulges under the weight of the liquid, within the box and fills up all space behind the bag's horizontally extending bottom portion.

Users are more familiar with a horizontal pushing or possibly pulling motion at a right angle to a dispenser. Although there are various mechanical motion devices for converting horizontal motion to vertical motion, they require a working space that is unavailable in the case of this prior art type of dispenser, because of the bulging bag above the fold line of the bag's horizontally folded portions containing the valve or pump.

One object of the present invention is to provide a liquid dispenser of the prior art type discussed above and which permits the use of a mechanical motion device which converts horizontal motion at right angles to the bag or box to downward force on the horizontally folded bag portion so as to press the bag's front wall down on the elastically flexible dome of the valve. At the same time it is desired to retain the advantage of the hermetically sealed bag containing the soap, exemplified by the use of the dispenser for antiseptic liquid soap in hospitals and the fact that when the bag is used in the box, liquid resupply is easily effected by removing and discarding the exhausted bag and replacing it with an unused hermetically sealed bag.

Briefly summarized, this invention comprises forming a hole completely through the bag at or adjacently above the fold line on which it is folded to bring its bottom portion containing the valve to the horizontal position. The hole can be formed by mutually registered openings in the front and back walls with the bag wall peripheries around the openings hermetically sealed together while leaving the bag walls unsealed at one or both ends of the openings so that the soap can flow down to the bag's bottom where the valve is located. The bag can be filled with the soap or other liquid and hermetically sealed for shipment. The bag can be folded on its fold line and its externally projecting check valve portion tucked into the bag's hole, permitting a number of the bags to be stacked into a shipping container.

For use the bag includes the box in which it is suspended. In this case the box has a back with short forwardly projecting shelf located above the part of the suspended bag having the hole and which projects through the hole so as to support the bag bulging forwardly against the inside of the front of the box and with its part having the hole vertically positioned. In this way a clear passageway is formed above the horizontally folded bottom portion of the bag having the valve, providing clearance for almost any kind of mechanical motion device for converting horizontal motion at a right angle to the bag and box into downward motion for pressing on the bag's front wall portion above the elastically collapsible dome which functions as the valve's operator and is on the inside of the bag. With the shelf bulging the bag against at least a portion of the box's front wall this portion can be made as a transparent window so that with the bag made of transparent or semi-transparent plastic its contents can be observed from outside the box.

One example of a dispenser, suitable for use with liquid soap and using the principles of this invention, is illustrated by the accompanying drawings, and described below.

Figure 1:
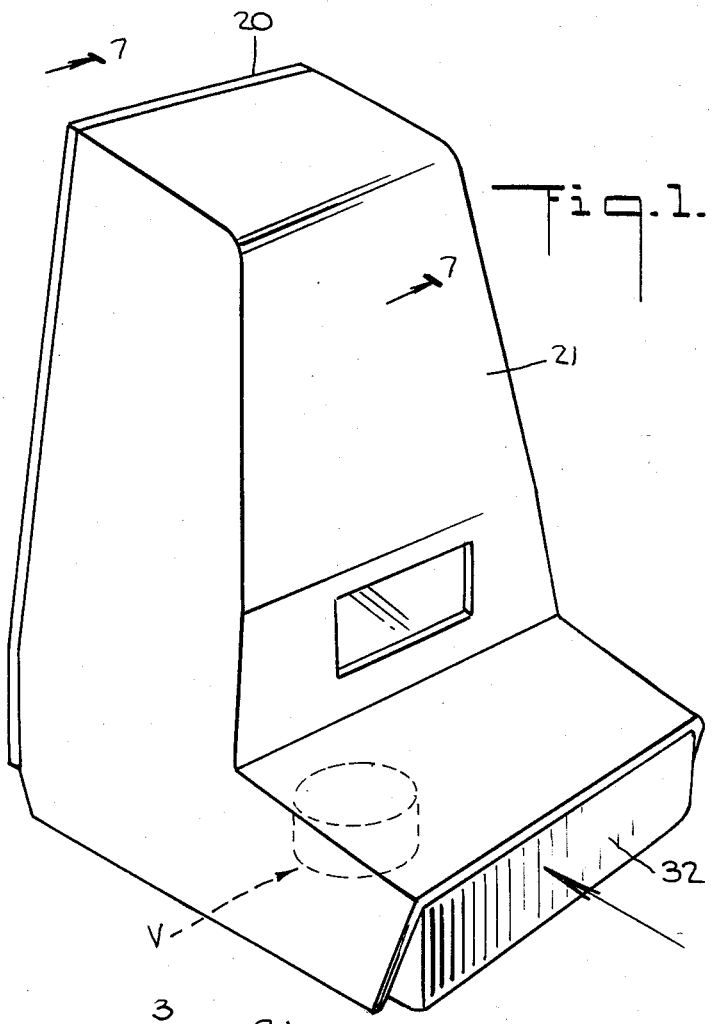
FIG. 1 is a perspective view showing one possible design of the box which contains the bag.
Figure 2:
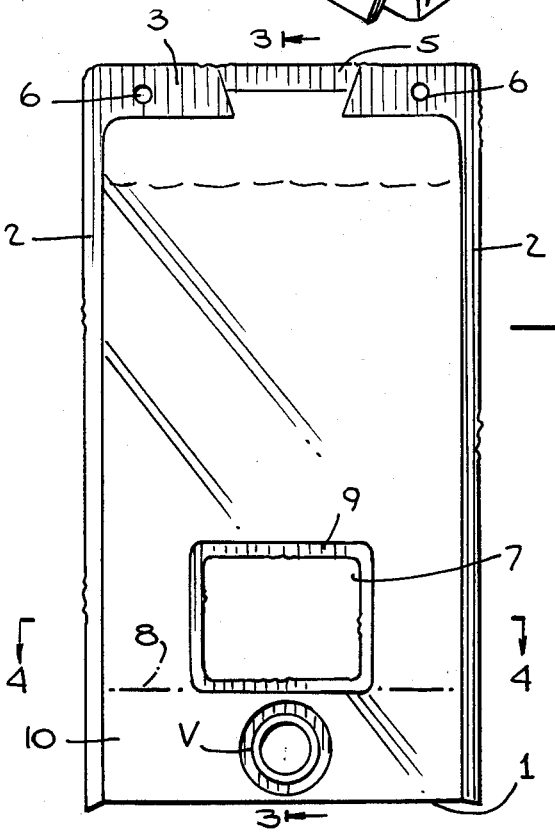
FIG. 2 is a plan front view of the bag.
Figure 3:
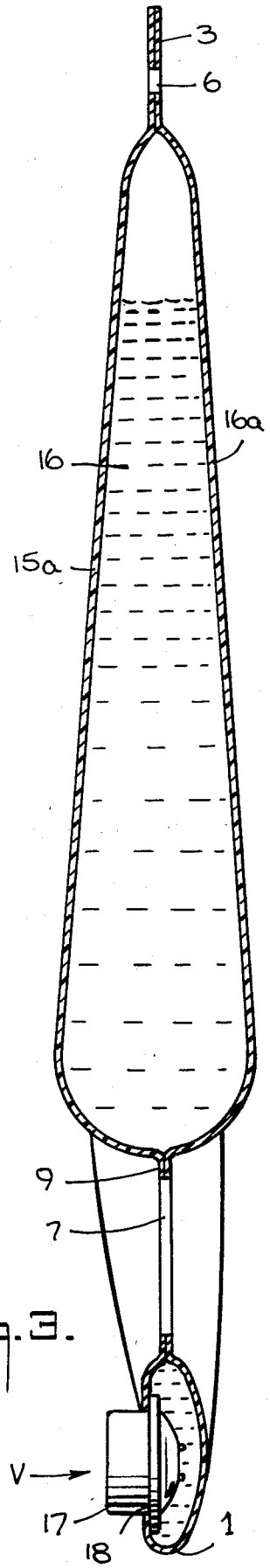
Figure 5:
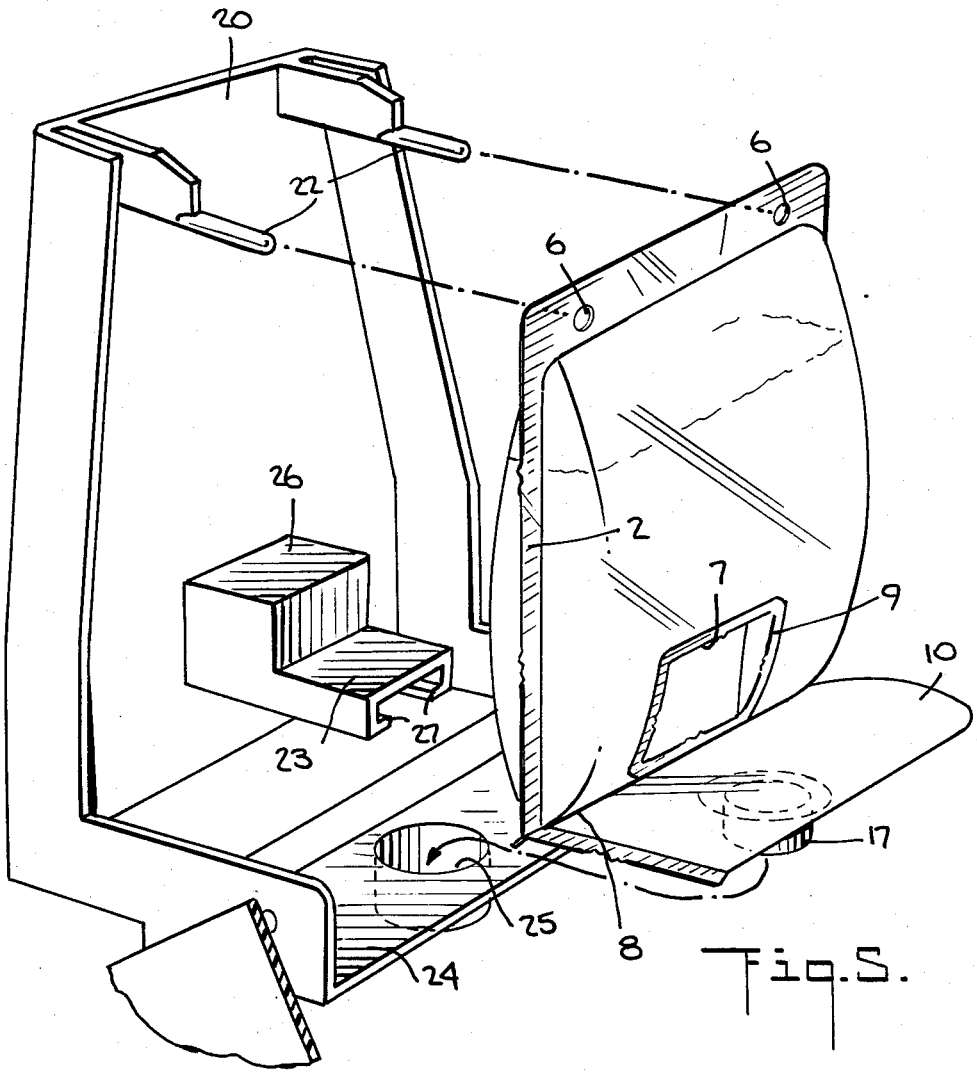
Figure 6:
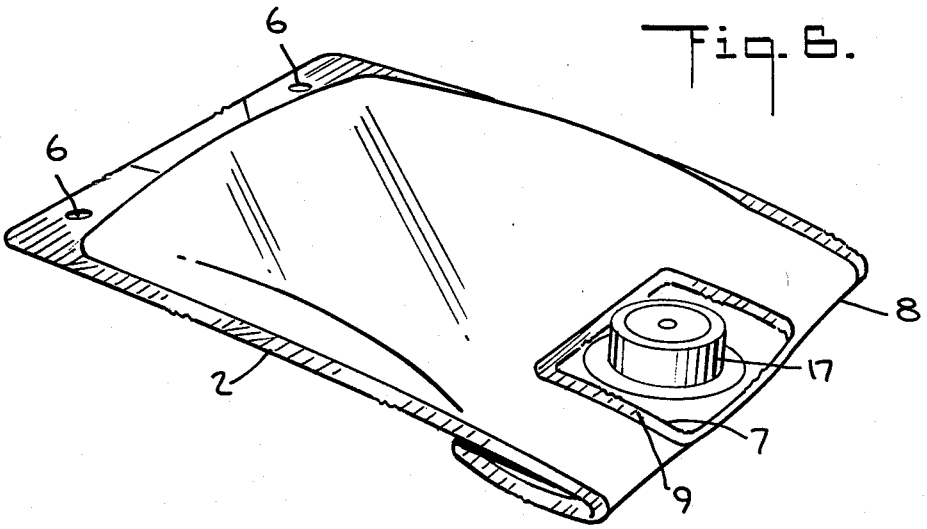
Figure 7:
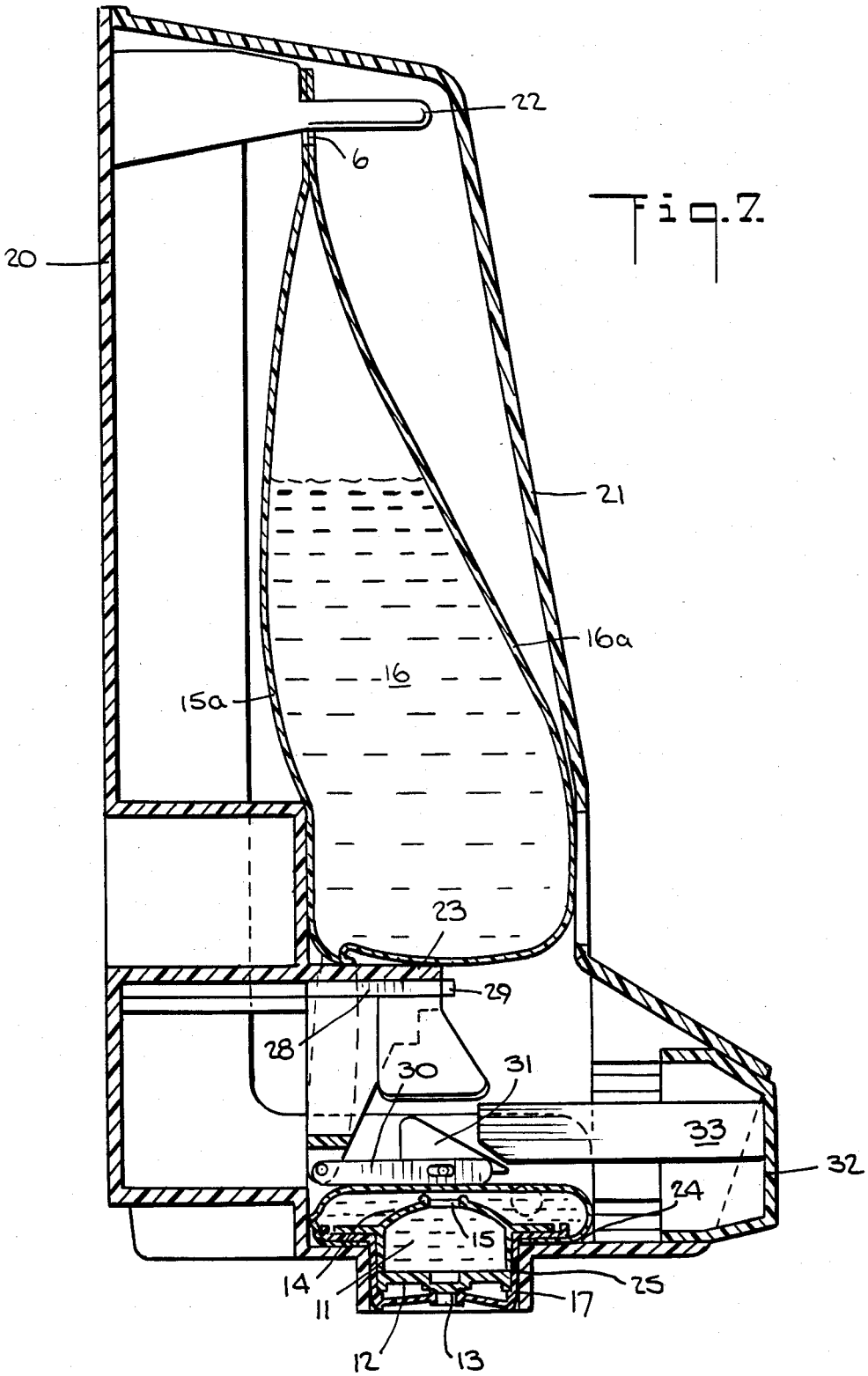
Figure 9:
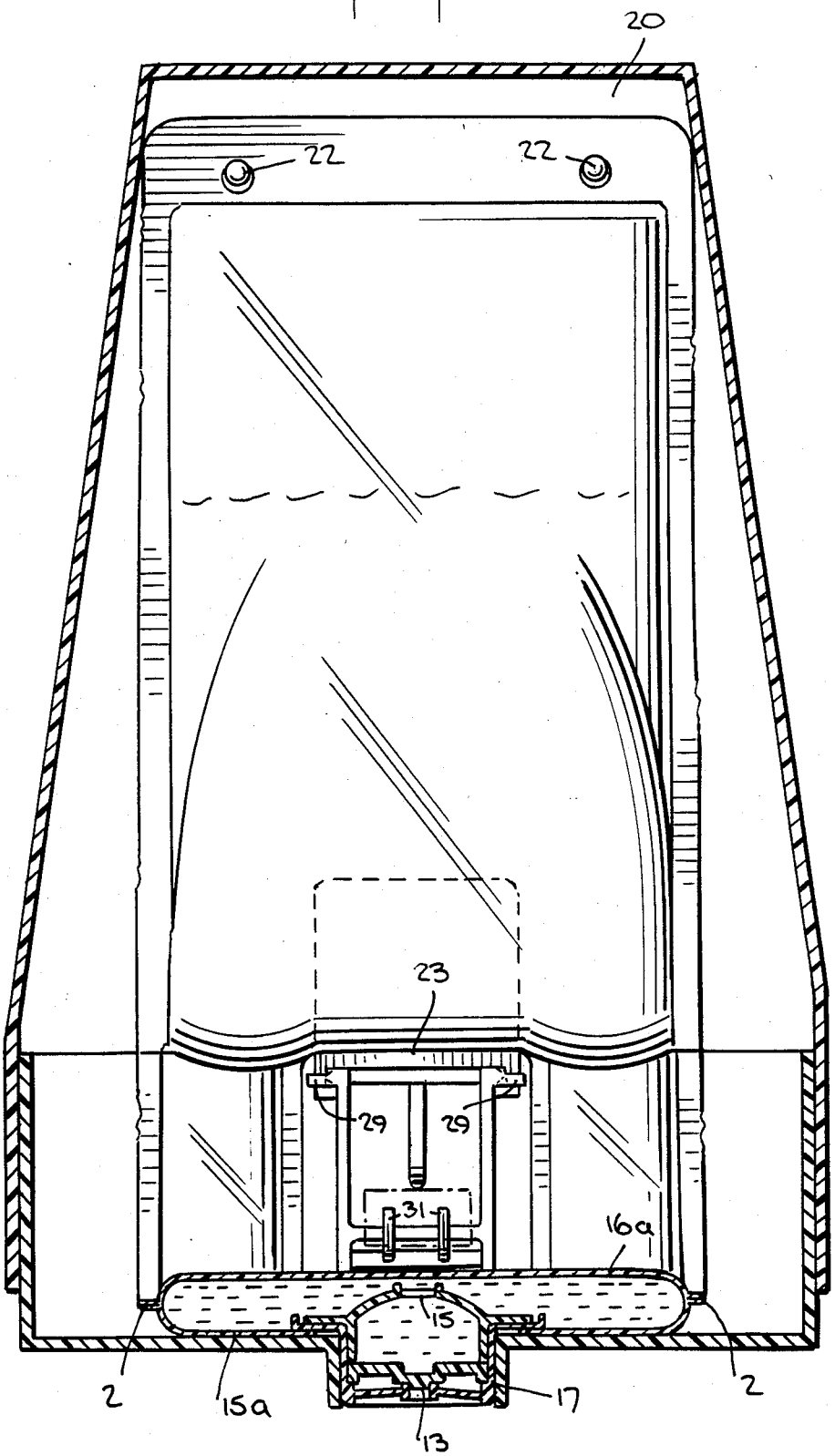

FIG. 3 in longitudinal section shows the bag on an enlarged scale;

FIG. 4 is a cross section of the bag, also on an enlarged scale;

FIG. 5 is an exploded perspective view showing the box with its front removed and the bag in its folded position and about to be inserted in the box;

FIG. 6 is a perspective view showing the bag as it can be folded for shipment or storage;

FIG. 7 is a vertical section of the box taken from front to back, with the bag inserted and the box closed;

FIG. 8 is a front view showing the bottom portion of the box with its cover partly broken away and showing the bag's valve operating mechanism in elevation; and FIG. 9 is a front view with the box's cover removed and showing the bag in elevation and its folded bottom portion and metering dispensing valve in vertical section.

As shown by FIGS. 2 through 6 the bag is made from a sheet of transparent flexible plastic, folded on a fold line 1 double on itself with side seams 2, heavier top seams 3 extending to an initially central opening through which the bag is filled with the soap and which is thereafter closed by a closing seam 5. Bag suspension holes 6 are formed through the heavier top seams 3.

The hole 7 is formed completely through the bag just above its fold line 8 for its bottom portion, the peripheral seam being shown at 9. In this case the hole is a rectangular contour and is horizontally elongated. The bag wall should not be seamed together so as to completely close off the main body of the bag from its bottom portion 10 where the dispensing valve V is positioned below the fold line 8.

In this case the valve is made substantially as disclosed by the Roggenburg and Laauwe application Ser. No. 391,846 filed June 24, 1982, now U.S. Pat. No. 4,478,356 dated Oct. 23, 1984, as shown particularly by FIGS. 7 and 9. It essentially comprises the metering chamber 11 formed on the bottom by the closure 12 and its check valve 13, and on its top by the elastically flexible dome 14 having the central hole 15. The bag is filled with liquid soap 16 and the valve's dome 14 is immersed in the liquid soap at the bottom of the bag when the bag is hung vertically, the check valve portion of the valve extending to the outside of the bag through the back wall 15*a* in the bottom portion in which the valve V is sealed hermetically.

With the dome 14 acting as an operator for the valve and located on the inside of the bag, opposite to the inside of the bottom portion 10 of the bag's front wall 16*a*, finger pressure on the outside of that portion of the wall 16, presses the inside of that portion against the dome 14, so as to discharge the soap in the chamber 11 through the check valve 13. The check valve portion of the valve V is formed by a tubular barrel assembly 17 having a flange 18 hermetically sealed to the inside of the bag portion surrounding the valve. The bag is filled with soap through its top opening 4 which is then sealed, and not through the valve V which is to all its parts is a permanent part of the bag. FIG. 6 shows how the bottom portion 10 of the bag can be folded double with the external barrel portion 17 tucked through the hole 7, permitting a number of the bags to be stacked and packaged for shipment.

To act as a liquid soap dispenser the bag includes a box having a back 20 and removable front 21. The back 20 can be fixed to the wall of a washroom for example, the front 21 being removable or possibly hinged so that it can be opened to install one of the bags as illustrated by FIG. 5. The box's back 20 at its top provides forwardly projecting pins 22 which are inserted in the holes 6 provided in the heavy seam portions 3 of the bag's top. The box's back 20 has a horizontal shelf 23 extending forwardly through the bag's hole 7 when the bag is suspended in the box, the bag at the top portion of the hole then resting on the shelf. The shelf and hole must be relatively proportioned so as to permit this arrangement. At a lower level the box has a horizontal flat support 24 for the bag's bottom portions 10 and this flat support 24 has an opening 25 down through which the bag's check valve part 17 extends.

The shelf 23 is positioned at a height substantially equaling the vertical distance between the top of the bag's hole 7 and the bag's fold line 8, the shelf supporting to a substantial extent the bag, which inherently bulges forwardly from the shelf, so that the part of the bag in which the hole 7 is formed is held in an approximately vertical position as can be seen from FIG. 7. When the box's front is closed the lower portion of the bag just above the shelf 23 bulges forwardly against a portion of the box as shown by FIG. 7. This portion is formed as a transparent window which may be glazed by a rigid transparent plastic. Thus with the bag itself being made of transparent plastic, it is possible to determine when the soap in the bag is nearing exhaustion, indicating the need for resupplying the box with another similar but full bag.

Now it can be seen that with the bag's bulging portion held upwardly by the shelf 23 there is a free horizontal space beneath the bag and above its horizontally folded bottom portion 10 via the hole or opening 7 of the bag. At the bottom of this space or passageway there is the front wall 16 of the bag's horizontally forwardly folded bottom portion 10 with its dispensing valve operator in the form of the dome 14 available for downward pressure to effect a metered discharge of soap. The shelf 23 extends forwardly from a back wall projection 26 spacing the shelf from the box's back wall so that there is recess behind the bag's hole 7. There is plenty of horizontal clearance for any of the various possibly mechanical motion devices previously referred to.

In the present example such a device comprises a cam assembly in the form of a carriage horizontally suspended for back and forth motion, by the bottom of the shelf 23 and its forwardly spacing part 26. This is done by forming these parts with a horizontally extending guideway 27 the cam assembly having flanges 28 which slide in this guideway 27. The cam assembly is proportioned so it can be slid backwardly through the bag's hole for installation and removal of the bag, and to prevent inadvertent sliding the flanges 28 at their front ends have spring releasable catches 29. In the forward position these latches hold the cam assembly against backward motion and when the latches are released the entire cam assembly can be pushed backwardly through the bag's hole and free from the bag. The cam assembly is proportioned so that it can pass through the bag's hole.

The cam assembly comprises a vertically movable presser 30 positioned above the front wall of the bag's forwardly folded bottom portion 10 and the valve's dome or operator 14 beneath the inside of this portion of the bag's front wall. This presser 30 is downwardly actuated by one or more cams 31. The front 21 of the box includes an externally accessible press member 32 from the inside of which one or more horizontal push rods 33 extend to the cam or cams 31, these two parts being separately from each other. When the front of the box is closed and the presser 32 is pushed forwardly at right angles to the box and the bag, the free end of the push rod or rods 33 engaged the cam or cams 31 so that the presser 30 is forced downwardly with consequent actuation of the valve.

When the front 21 of the box is opened, the push rod or rods 33 are carried away because they are attached to this front. The catches 20 are released and the cam assembly pushed backwardly and free from the bag. Then the bag can be removed by being pulled forwardly and free from the shelf 23, and replaced with another bag. With the cam assembly pulled forwardly through the new bag's hole the latches 29 can be engaged and the box's front reapplied or swung back if hinged. The dispenser is then back in servicable condition.

What is claimed is:

1. A liquid dispenser comprising a flexible bag adapted to be positioned upright and contain the liquid and having front and back walls with bottom portions and a dispensing valve in the bottom portion of the back wall, the valve having an operator inside the bag and actuated by pressing the bottom portion of the front wall against the operator, the bottom portions of the two walls being foldable on a transverse fold line to horizontal positions so as to superimpose the bottom portion of the front wall on the bottom portion of the back wall and the operator; wherein the improvement comprises the front and back walls being formed with mutually registered openings above the fold line, the openings having peripheries which are sealed fluid-tightly together and the openings forming a horizontal passage extending right-angularly through the bag above the fold line, said liquid dispenser having an enclosing box having an openable front closure and suspension means for suspending the bag therein by the top of the bag when the bag contains the liquid, the box having a support for the bag's bottom portions when they are folded to the horizontal positions, the box having a movable pressing means for pressing the lower portion of the front wall against the operator of the valve and at least a portion of the pressing means being movable through the passage.

2. The liquid dispenser of claim 1 in which the box has a horizontal shelf extending from the box's back and forwardly through the bag's passage so as to support the bag above its passage.

3. The liquid dispenser of claim 2 in which the shelf is positioned so as to cause the front wall of the bag to bulge forwardly above this shelf and into contact with a portion of the box's front closure when the latter is closed.

4. The liquid dispenser of claim 3 in which said portion of the front closure comprises a window and the bag is transparent so its content can be seen through the window.

5. The liquid dispenser of claim 2 in which said movable pressing means comprises an assembly movably supported by the bottom of the shelf so as to permit the assembly to be horizontally moved backwardly through the bag's passage, and the box's front closure has an actuator for the assembly and which extends to and is removably associated with the assembly.

* * * * *